United States Patent [19]

Crutchfield et al.

[11] 4,148,742

[45] Apr. 10, 1979

[54] DETERGENT COMPOSITION CONTAINING ALKALI METAL SALTS OF IMIDOBIS SULFURIC ACID

[75] Inventors: Marvin M. Crutchfield, St. Louis County; Robert P. Langguth, Overland; James M. Mayer, Maryland Heights, all of Mo.

[73] Assignee: Monsanto Company, St. Louis, Mo.

[21] Appl. No.: 838,279

[22] Filed: Sep. 30, 1977

[51] Int. Cl.[2] ..... C11D 7/60

[52] U.S. Cl. ..... 252/102; 8/108 R; 8/109; 252/89 R; 252/187 H; 423/385; 423/388

[58] Field of Search ..... 252/102, 187 H, 89 R; 423/385, 388; 8/108 R, 109

[56] References Cited

U.S. PATENT DOCUMENTS 4,088,611 5/1978 Suzuki et al. ..... 252/89 R

FOREIGN PATENT DOCUMENTS 2545611 4/1976 Fed. Rep. of Germany ..... 252/89 R

*Primary Examiner*—Mayer Weinblatt

*Attorney, Agent, or Firm*—S. M. Tarter; E. P. Grattan; F. D. Shearin

[57] ABSTRACT

The alkali metal salts of imidobis sulfuric acid, particularly the trisodium salt, is effective in heavy duty laundry detergent compositions by reducing the damaging effects of chlorine-containing bleaches on the fabric while minimizing the loss in effectiveness of the bleach in removing stains from the soiled fabric. Accordingly, a detergent composition is provided which comprises, based on the total weight of the composition, at least 5 percent by weight of a surfactant selected from the group consisting of anionic, nonionic, zwitterionic, ampholytic and amphoteric surfactants, at least 5 percent by weight of a builder, and a bleach-damage mitigating amount of trisodium imidobis sulfate, tripotassium imidobis sulfate or mixtures thereof. A process for washing soiled fabrics is also provided comprising contacting the fabrics with a detergent, a chlorine-containing bleach, and a bleach-damage mitigating amount of the alkali metal imidobis sulfate.

7 Claims, 1 Drawing Figure

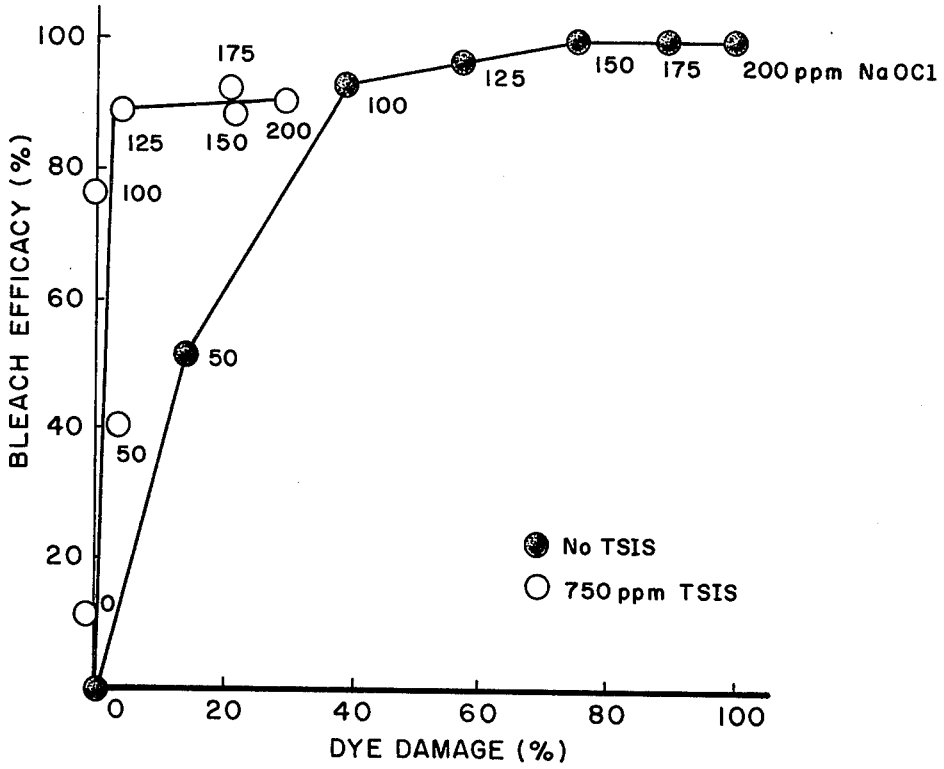
BLEACH EFFICACY (%)
DYE DAMAGE (%)
100
80
60
40
20
0
20
40
60
80
100
175
125
150
200
100
50
0
125
150
175
200 ppm NaOCl
100
50
No TSIS
750 ppm TSIS

DETERGENT COMPOSITION CONTAINING ALKALI METAL SALTS OF IMIDOBIS SULFURIC ACID

BACKGROUND OF THE INVENTION

This invention relates to detergent compositions and more particularly to detergent compositions containing trisodium imidobis sulfate, tripotassium imidobis sulfate or mixtures thereof. The invention also relates to the use of such compositions in washing processes.

Detergent compositions containing a water soluble detergent surfactant and generally a builder which is used to sequester calcium and magnesium ions and to improve detergency levels of soaps and synthetic detergents, are widely used in home and industrial laundries for cleaning fabrics. Such detergent compositions may also contain fillers, such as sodium sulfate, and minor amounts of optical brighteners, soil antiredeposition agents, perfumes and the like. Although such detergent compositions effectively remove soil from fabrics, such as polyester, polyester/cotton, cotton and the like, certain stains, such as tea stains and grape juice stains, are very difficult to remove from fabrics using conventional detergent formulations.

To remove stains caused by tea, grape juice and the like, it is a common laundry practice to add a halogen-containing bleach, such as sodium hypochlorite, to remove such stains from fabrics. Although such halogen-containing bleaches can effectively remove the stain, such stain removal is accompanied by some damage to dyed fabrics. It is also desirable, if not necessary, to segregate white clothes from colored clothes to minimize the deleterious effect of normal use levels of chlorine-containing bleaches on colored fabrics and to prevent transfer of dye from colored fabrics to white fabrics.

To overcome these problems, those skilled in the art of detergent formulations have long been interested in a material that would mitigate the deleterious effect of halogen-containing bleaches on fabrics, particularly colored fabrics, without loss of desirable bleaching properties. Compounds heretofore considered which mitigated the deleterious effect of halogen-containing bleaches on colored fabrics also prevented adequate bleaching of stains.

Now, a material has been found that permits adequate bleaching of stains during washing while mitigating the damaging effects of halogen-containing bleaches on colored fabrics, permitting the formulation of new and novel detergent compositions. Such an improved laundry detergent formulation permits the use of halogen-containing bleaches with colored fabrics with reduced fear of damage to the color. Moreover, the necessity for separating colored fabrics from white fabrics during the wash/bleach operation is reduced or even eliminated.

This bleach damage mitigating effect is achieved by adding an alkali metal salt of imidobis sulfuric acid, such as trisodium imidobis sulfate, tripotassium imidobis sulfate or mixtures thereof to the detergent composition. Such compounds and methods of their preparation are known to the art (see for example, J. W. Mellor, "A comprehensive Treatice on Inorganic and Theoretical Chemistry," Longmans, Green & Co., Ltd., London, 1931, Vol. VIII, pages 647 through 660). It is most economically made from ammonia, sulfur trioxide and sodium hydroxide as basic raw materials. More recently, several Japanese patents relating to process reactor design, crystalline trisodium salts and hydrates and the use of trisodium imidobis sulfate as a builder to replace sodium tripolyphosphate (STP) in detergent formulations have appeared (see for example, Japanese Pat. Nos. 71,06,495; 73,132,772; 74,119,983; and 75,132,772). However, our evaluation indicated that trisodium imidobis sulfate was a rather poor detergent builder, having about 25 percent of the effectiveness of STP; and while it might be effective as a builder in detergent formulations for use in relatively soft water having less than about 50 ppm (as $CaCO_3$) of hardness, in water having more than about 50 ppm of hardness, a builder having a stronger binding affinity for calcium and magnesium ions, such as STP, would be necessary in order to provide the desired optimum detergent builder characteristics.

Now it has been found that a detergent formulation can be prepared in which trisodium imidobis sulfate acts not as a builder but as a special additive which will mitigate the effect of halogen-containing bleaches on colored fabrics while still permitting the bleach to have its desired end effect on undesirable stains and on vagrant dyes in solution. The use of such a detergent formulation along with bleach reduces the necessity for the housewife or industrial laundry to segregate white fabrics from colored fabrics during the washing cycle and is of particular interest when, for example, printed fabrics containing a mixture of white and colors are cleaned. Colored fabrics washed in the detergent composition of the present invention maintain their color brightness almost as though no bleach were present.

SUMMARY OF THE INVENTION

These and other advantages are achieved with a detergent composition comprising, based on the total weight of the composition, at least 5 percent by weight of a surfactant selected from the group consisting of anionic, nonionic, zwitterionic, ampholytic and amphoteric surfactants, at least 5 percent by weight of a builder and a bleach damage mitigating amount of trisodium imidobis sulfate, tripotassium imidobis sulfate or mixtures thereof. The present invention also contemplates a process for washing soiled fabrics comprising contacting the fabrics with an aqueous detergent composition which includes a surfactant, a halogen-containing bleach and a bleach damage mitigating amount of trisodium imidobis sulfate, tripotassium imidobis sulfate or mixtures thereof.

The property possessed by some materials of improving detergency levels of soaps and synthetic detergents and the use of such materials in detergent compositions is known. Such cleaning boosters are called "builders" and such builders permit the attainment of better cleaning performance than is possible when so-called unbuilt compositions are used. Although the behavior and mechanisms by which builders perform their function are only partially understood, it is known that good builders must be able to sequester most of the calcium and/or magnesium ions in the wash water since these ions are detrimental to the detergency process.

Although satisfactory bleach mitigating results are achieved by the composition of the present invention when a builder is not present, it is preferred to use at least 5 percent by weight of a builder to sequester calcium and magnesium ions. In order to obtain the maximum advantages of the compositions of this invention, the detergent composition should preferably contain from about 5 percent to about 25 percent or even higher, say up to 60 percent by weight builder. Only one detergency builder can be used or a combination of detergency builders can be used. By way of example, builders which can be employed either alone or in combination with other builders in accordance with this invention include either water insoluble materials, such as sodium aluminosilicates, commonly known as zeolites, or water soluble inorganic builder salts such as alkali metal polyphosphates, i.e., the tripolyphosphates and pyrophosphates, alkali metal carbonates, borates, bicarbonates and silicates and water soluble organic builders, including amino polycarboxylic acids and salts, such as alkali metal nitrilotriacetates, cycloalkane polycarboxylic acids and salts, ether polycarboxylates, alkyl polycarboxylates, epoxy polycarboxylates, tetrahydrofuran polycarboxylates, such as 1,2,3,4 or 2,2,5,5 tetrahydrofuran tetracarboxylates, benzene polycarboxylates, oxidized starches, amino(trimethylene phosphonic acid) salts, diphosphonic acid salts (e.g., the sodium salts of methylene diphosphonic acid or 1-hydroxy ethylidene 1,1-dimethylene phosphonic acid), polymeric polycarboxylates, and the like.

The total amount of builder employed will be dependent on the intended use of the detergent composition, other ingredients of the composition, pH conditions, water hardness values, and the like. For example, general laundry powder formulations will usually contain from about 20 percent to about 60 percent builder. Optimum levels of builder content as well as optimum mixtures of builders of this invention with other builders for various uses can be determined by routine tests in accordance with conventional detergent formulation practice.

The quantity of surfactant employed in the detergent compositions of this invention will depend on the surfactant chosen and the intended end use. Any water soluble anionic, nonionic, zwitterionic or amphoteric surfactant can be employed. In general, the compositions will contain from 5 percent to 50 percent surfactant by weight, although as much as 95 percent surfactant may be employed if desired. For example, general laundry powder formulations normally contain 5 percent to 50 percent, preferably 10 percent to 25 percent surfactant by weight. The weight ratio of surfactant to builder will generally be in the range of from 1:12 to 2:1.

Examples of suitable anionic surfactants include soaps such as the salts of fatty acids containing about 9 to 20 carbon atoms, e.g., salts of fatty acids derived from coconut oil and tallow; alkyl benzene sulfonates—particularly linear alkyl benzene sulfonates in which the alkyl group contains from 10 to 16 carbon atoms; alcohol sulfates; ethoxylated alcohol sulfates, hydroxy alkyl sulfonates; alkyl sulfates and sulfonates; monoglyceride sulfates; acid condensates of fatty acid chlorides with hydroxy alkyl sulfonates; and the like.

Examples of suitable nonionic surfactants include alkylene oxide (e.g., ethylene oxide) condensates of mono- and polyhydroxy alcohols, alkyl phenols, fatty acid amides, and fatty amines; amine oxides; sugar derivatives such as sucrose monopalmitate; long chain tertiary phosphine oxides, dialkyl sulfoxides; fatty acid amides, (e.g., mono- or diethanol amides of fatty acids containing 10 to 18 carbon atoms); and the like.

Examples of suitable zwitterionic surfactants include derivatives of aliphatic quaternary ammonium compounds such as 3-(N,N-dimethyl-N-hexadecylammonio)propane-1-sulfonate and 3-(N,N-dimethyl-N-hexadecylammonio)-2-hydroxy propane-1-sulfonate.

Examples of suitable amphoteric surfactants include betains, sulfobetains and fatty acid imidazole carboxylates and sulfonates.

It will be understood that the above examples of surfactants are by no means comprehensive and that numerous other surfactants are known to those skilled in the art. It will be further understood that the choice and use of surfactants will be in accordance with well understood practices of detergent formulation. For example, anionic surfactants, particularly linear alkyl benzene sulfonate, are preferred for use in general laundry formulations.

The detergent formulations of the present invention may optionally contain solid halogen-containing bleaches if the detergent composition is dry, or liquid bleaches such as 5 percent sodium hypochlorite may be added at the time of the wash. Halogen-containing bleaches which are mitigated by the presence of trisodium or tripotassium imidobis sulfate include sodium hypochlorite, calcium hypochlorite and the sodium and potassium salts of dichloroisocyanurate, trichloroisocyanuric acid and (monotrichloro)tetra(monopotassium dichloro)pentaisocyanurate and the like. Although other halogen-containing bleaches may be used, chlorine-containing bleaches are preferred for detergent applications. Liquid detergent formulations containing halogen-containing bleaches are not satisfactory in the composition of the present invention although it is contemplated that the present detergent composition can be liquid if the halogen-containing bleach is added separately to the washing cycle.

In most washing processes, a sufficient amount of a separate halogen-containing bleach, say sodium hypochlorite, is added to the wash water to bring the concentration of the chlorine up to about 200 ppm. In American home laundry practices, this is equivalent to about 1 cup of bleach per full washer load. In general practice, the bleach is added separately from the detergent at a level between ½ cup per washer load (about 100 ppm) and 1 full cup (200 ppm) during the washing cycle, although smaller quantities are sometimes added.

The amount of the alkali metal salt of imidobis sulfuric acid for use in the detergent composition of the present invention can vary within wide limits, although it is preferred that it be present in molar excess over the bleach. It has been found that for any use level of hypochlorite bleach in the washing cycle the ratio of bleaching efficiency to dye damage in the fabric is better when an excess of alkali metal salt of imidobis sulfuric acid is present. For hypochlorite bleach levels less than 200 ppm in the wash water (the recommended use level) the efficiency to damage ratio in the presence of an excess stoichiometric amount of the alkali metal salt of imidobis sulfuric acid was better than the best ratio obtained in the absence of such salt. At 200 ppm sodium hypochlorite and using a stoichiometric excess of the salt (about 750 ppm by weight) damage to the dye in the fabric was reduced by 70 percent while the bleaching efficiency for stains was reduced by only 10 percent. At 100 ppm sodium hypochlorite levels and about 750 ppm by weight of the bleach-mitigating salt, the presence of the salt nearly eliminated the damage to the dyes while bleaching efficiency on stains was lowered by only 20 percent.

When these ppm levels of the alkali metal salts of imidobis sulfuric acid are translated to concentrations in a detergent composition used at the recommended levels of about 1 cup per washer load, the detergent composition should contain at least 10 weight percent of the salt, although it is clear that lesser quantities could be used. Higher concentrations to more completely mitigate bleach damage to the dyes in the fabric are preferred, say at least 25 weight percent, and preferably between 25 weight percent and about 75 weight percent. Clearly, higher concentrations could be used but only at the expense of the presence of surfactants or builders. Optimum quantities of surfactant, builder, and the bleach-mitigating salts of the present invention can be established by routine testing in accordance with conventional detergent formulation practice.

BRIEF DESCRIPTION OF DRAWING

To facilitate an understanding of the bleach damage mitigating effect of trisodium imidobis sulfate (TSIS) as a function of bleaching efficacy, the FIGURE plots the data obtained in Example II which compares bleaching in the presence and absence of 750 ppm TSIS with up to 200 ppm of sodium hypochlorite. The reflectance for each color was summed for each test. The results, shown in detail in the Table in Example II, were normalized for the drawing such that the total reflectance for no bleach was set at 0 and the total reflectance for 200 ppm bleach without TSIS was set at 100.

DESCRIPTION OF THE PREFERRED EMBODIMENTS

This invention is illustrated by, but not limited to, the following Examples wherein all percentages are by weight unless otherwise noted.

EXAMPLE I

Trisodium imidobis sulfate was prepared by the method described by P. Baumgarten, *BER*, 6913, 2929–2937 (1936). To 57 grams (0.5 mole) ammonium sulfamate in a 400 milliliter beaker was added 48.5 grams (0.5 mole) sulfamic acid. The solids in the beaker were heated on a hot plate. At about 120° C., a stirrable melt was obtained and at about 150° C., the melt began to solidify. The beaker was removed from the hot plate, and when the solid was cool, it was broken apart and dissolved in 128 grams of 50 percent sodium hydroxide to which water was added to bring the total volume to 450 milliliters. The solution was heated to expel ammonia, cooled to room temperature, and filtered. The solution was chilled to 5° C., and a seed crystal was added, whereupon a precipitate instantly formed. The precipitate was recovered by filtration, and dried in vacuo at room temperature. Analysis showed that 82.6 grams of $NaN(So_3Na)_2.H_2O$ was obtained.

EXAMPLE II

The trisodium imidobis sulfate from Example I was used in a series of experiments to compare bleaching in the presence and absence of the salt. A sufficient quantity of the salt was added so that at least a stoichiometric amount was present for bleach levels up to about 200 ppm in the wash water. The sodium hypochlorite bleach was added before the fabric was added to the wash water. Two common stains, tea and grape juice, were chosen to test the bleach efficiency. To test damage, two fabrics with bleach sensitive dyes, i.e., blue jean and a brown cotton, were chosen to give the dyes and stains with similar colors (blue and brown). The dye damage tests were run for three cycles to give the data more precision. The bleach studies were run for various levels of bleach so that the effects of the trisodium imidobis sulfate could be compared with different bleach levels.

After washing, the swatches were read on a Gardner XL-23 Colorimeter. The XYZ values (percent reflectance of green, red and blue light, respectively) were read before and after washing. Since the dyes and stains were consistent, the ratio of initial values was similar. This allowed the final XYZ values to be compared directly.

To perform the tests, water containing 100 ppm hardness with a calcium to magnesium ratio of 3:2 was used with 1500 ppm of a typical commercial detergent. The detergent contained linear alkyl benzene sulfonate as the surfactant and sodium tripolyphosphate as a builder along with minor amounts of other detergent ingredients. The wash water was at 120° F. (about 60° C.) and the cycle time was ten minutes.

The results, presented in Table 1 and in the drawing, show that the addition of TSIS gives much better efficacy to damage ratios when compared with the same level of bleach and no TSIS. In fact, since the lines do not cross in the drawing, no bleach level without TSIS can give as favorable bleaching as any level with TSIS. Although slightly higher bleaching can be obtained without TSIS, the differences are not easily seen while the dye damage effects are obvious.

| | | Final YXZ Values for Damage and Efficacy | | | | | | | | | | | | | |
|---|---|---|---|---|---|---|---|---|---|---|---|---|---|---|---|
| | | Dye Damage | | | | | | | Bleaching Efficacy | | | | | | |
| NaOCl | TSIS | Brown Cloth | | | Blue Jean | | | | Tea | | | Grape | | | |
| Level | Level | Y | X | Z | Y | X | Z | Σ | Y | X | Z | Y | X | Z | Σ |
| 0 ppm | 0 ppm | 6.8 | 7.9 | 5.2 | 3.2 | 3.4 | 7.1 | 33.6 | 74 | 74 | 76 | 60 | 58 | 73 | 415 |
| | 750 | 6.7 | 7.8 | 5.1 | 3.1 | 3.2 | 6.7 | 32.6 | 72 | 72 | 73 | 68 | 67 | 78 | 430 |
| 50 | 0 | 8.3 | 9.7 | 6.5 | 3.9 | 4.1 | 6.8 | 39.3 | 87 | 85 | 94 | 70 | 69 | 74 | 479 |
| | 750 | 7.5 | 8.7 | 5.8 | 3.3 | 3.5 | 6.2 | 35.0 | 84 | 83 | 88 | 69 | 68 | 74 | 466 |
| 100 | 0 | 11.1 | 12.8 | 8.8 | 4.9 | 5.1 | 7.3 | 50.0 | 87 | 85 | 96 | 87 | 85 | 92 | 532 |
| | 750 | 7.1 | 8.2 | 5.5 | 3.2 | 3.3 | 6.0 | 33.3 | 87 | 84 | 93 | 82 | 80 | 85 | 511 |
| 125 | 0 | 13.1 | 15.1 | 10.6 | 5.5 | 5.9 | 7.8 | 58.0 | 87 | 86 | 97 | 87 | 85 | 93 | 536 |
| | 750 | 7.6 | 8.8 | 5.9 | 3.4 | 3.6 | 6.0 | 35.3 | 88 | 86 | 95 | 85 | 83 | 89 | 526 |
| 150 | 0 | 15.0 | 17.1 | 12.5 | 6.1 | 6.5 | 8.3 | 65.5 | 88 | 86 | 98 | 88 | 86 | 94 | 540 |
| | 750 | 9.3 | 10.7 | 7.2 | 4.2 | 4.4 | 6.9 | 42.7 | 88 | 86 | 95 | 85 | 83 | 89 | 526 |
| 175 | 0 | 15.7 | 17.9 | 13.0 | 7.5 | 8.1 | 9.2 | 71.4 | 88 | 86 | 97 | 88 | 86 | 95 | 540 |
| | 750 | 9.3 | 10.7 | 7.2 | 4.1 | 4.3 | 6.6 | 42.2 | 88 | 86 | 97 | 86 | 84 | 90 | 531 |
| 200 | 0 | 17.3 | 19.6 | 14.7 | 7.3 | 7.9 | 9.1 | 75.9 | 88 | 86 | 97 | 88 | 86 | 95 | 540 |
| | 750 | 10.1 | 11.7 | 7.8 | 4.5 | 4.8 | 6.9 | 45.8 | 88 | 86 | 97 | 85 | 83 | 90 | 529 |
| 300 | 0 | 22.1 | 24.7 | 19.3 | 12.1 | 13.2 | 13.1 | 104.5 | 87 | 85 | 96 | 88 | 86 | 96 | 538 |

-continued

| | | Final YXZ Values for Damage and Efficacy | | | | | | | | | | | | | |
|---|---|---|---|---|---|---|---|---|---|---|---|---|---|---|---|
| | | Dye Damage | | | | | | | Bleaching Efficacy | | | | | | |
| NaOCl | TSIS | Brown Cloth | | | Blue Jean | | | | Tea | | | Grape | | | |
| Level | Level | Y | X | Z | Y | X | Z | Σ | Y | X | Z | Y | X | Z | Σ |
| | 750 | 12.2 | 14.0 | 9.6 | 5.8 | 6.3 | 8.2 | 56.1 | 87 | 85 | 96 | 86 | 84 | 92 | 530 |

Y = green reflectance
X = red reflectance
Z = blue reflectance

Although the invention has been described in terms of specified embodiments which are set forth in considerable detail, it should be understood that this is by way of illustration only and that the invention is not necessarily limited thereto since alternative embodiments and operating techniques will become apparent to those skilled in the art in view of the disclosure. As an example, the detergent composition of the present invention may contain fillers, such as sodium sulfate, and minor amounts of dyes, optical brighteners, soil antiredeposition agents, perfumes and the like. Accordingly, modifications are contemplated which can be made without departing from the spirit of the described invention.

What is claimed is:

1. A process for washing soiled fabrics comprising contacting the fabrics with an aqueous detergent composition which includes a surfactant, a halogen-containing bleach, and a bleach damage mitigating amount of trisodium imidobis sulfate, tripotassium imidobis sulfate or mixtures thereof.

2. A process of claim 1 wherein the detergent composition includes a bleach damage mitigating amount of trisodium imidobis sulfate and the chlorine bleach is sodium hypochlorite.

3. A detergent composition comprising, based on the total weight of the composition:

A. at least 5 percent by weight of a surfactant selected from the group consisting of anionic, nonionic, zwitterionic, ampholytic, and amphoteric surfactants;

B. at least 5 percent by weight of a builder;

C. a solid, chlorine-containing bleach; and

D. a bleach damage mitigating amount of trisodium imidobis sulfate, tripotassium imidobis sulfate, or mixtures thereof.

4. A detergent composition of claim 3 wherein the bleach damage mitigating amount is at least 10 percent by weight.

5. A detergent composition of claim 3 wherein trisodium imidobis sulfate is used to mitigate bleach damage.

6. A detergent composition of claim 3 wherein the bleach damage mitigating amount is at least 25 percent by weight.

7. A detergent composition of claim 6 or 13 wherein the bleach damage mitigating amount is between about 25 and about 75 percent by weight.

* * * * *

UNITED STATES PATENT AND TRADEMARK OFFICE

CERTIFICATE OF CORRECTION

PATENT NO. : 4,148,742

DATED : April 10, 1979

INVENTOR(S) : Marvin M. Crutchfield, Robert P. Langguth and James M. Mayer

It is certified that error appears in the above-identified patent and that said Letters Patent are hereby corrected as shown below:

Column 8, Claim 7, line 1, "claim 6 or 13" should read --- claim 6 or 5 ---.

Signed and Sealed this

*Eighteenth* Day of *September 1979*

[SEAL]

*Attest:*

*Attesting Officer*

LUTRELLE F. PARKER

*Acting Commissioner of Patents and Trademarks*